US006857755B1

(12) United States Patent
Lewis

(10) Patent No.: US 6,857,755 B1
(45) Date of Patent: Feb. 22, 2005

(54) ILLUMINATED BOTTLE CAP WITH EPOXY DOME

(75) Inventor: Edward D. Lewis, Brownsburg, IN (US)

(73) Assignee: Buztronics, Inc., Indianapolis, IN (US)

( * ) Notice: Subject to any disclaimer, the term of this patent is extended or adjusted under 35 U.S.C. 154(b) by 0 days.

(21) Appl. No.: 10/659,148

(22) Filed: Sep. 10, 2003

(51) Int. Cl.[7] ..... F21W 121/06

(52) U.S. Cl. ..... 362/104; 362/191; 362/249; 362/398

(58) Field of Search ..... 362/103, 104, 362/184, 191, 190, 249, 252, 398, 800, 806

(56) References Cited

U.S. PATENT DOCUMENTS

| | | | | |
|---|---|---|---|---|
| 3,025,991 A | | 3/1962 | Gillon | |
| D227,541 S | | 7/1973 | Himmel | D7/154 |
| 3,866,035 A | * | 2/1975 | Richey, Jr. | 362/104 |
| 4,009,381 A | | 2/1977 | Schreiber et al. | 240/1 EL |
| 4,215,388 A | * | 7/1980 | Reimann | 362/104 |
| 4,337,871 A | | 7/1982 | Tucker | 215/328 |
| 5,143,439 A | | 9/1992 | Lewis et al. | 362/103 |
| D375,264 S | | 11/1996 | Galarza et al. | D9/453 |
| 6,013,346 A | | 1/2000 | Lewis et al. | 428/78 |
| 6,174,075 B1 | * | 1/2001 | Fuwausa | 362/310 |
| D495,255 S | * | 8/2004 | Lewis | D9/436 |
| 2004/0032734 A1 | * | 2/2004 | Chen | 362/189 |

OTHER PUBLICATIONS

Buzline 2002 Catalog, 3 pages.
PlayVisions 2002 Supplement catalog, 2 pages.
Moslink Electronic Ltd. Catalog, 2003, 2 pages.

* cited by examiner

*Primary Examiner*—Laura K. Tso
(74) *Attorney, Agent, or Firm*—William F. Bahret

(57) ABSTRACT

An illuminated magnetic-clasp bottle cap comprising a bottle cap with a printed circuit board mounted thereon, the printed circuit board having an IC flasher circuit including a plurality of COB LEDs mounted thereon, the bottle cap further comprising a low-profile epoxy dome covering the LEDs, a battery holder extending below the printed circuit board and the central portion of the bottle cap and containing at least one battery operatively connected to the IC flasher circuit, and a magnetic clasp for holding the bottle cap on an object with first and second mutually attractive parts of the magnetic clasp located respectively on first and second surfaces of the object.

5 Claims, 1 Drawing Sheet

ILLUMINATED BOTTLE CAP WITH EPOXY DOME

BACKGROUND OF THE INVENTION

This invention relates to illuminated articles, and more particularly to illuminated articles designed to be worn on clothing.

Many types of illuminated articles have been made or proposed for clothing, such articles including permanently affixed displays as well as removable items such as illuminated buttons, badges, pins and stickers among others. For example, U.S. Pat. No. 5,143,439, assigned to the assignee of the present invention, discloses a blinking button with an attachment pin which also functions as an ON-OFF switch for a flasher circuit. Blinking buttons in the form of a bottle cap are also known. Lighted buttons have also been made with magnetic clasps having two mutually attractive parts designed to be placed on opposite surfaces of a piece of fabric, for example, in order to hold the button on the fabric magnetically. An example of a lighted sticker for clothing is disclosed in U.S. Pat. No. 6,013,346, also assigned to the assignee of the present invention. U.S. Pat. No. 4,009,381 discloses an example of a lighted pin designed to be worn on clothing.

While there are and have been numerous illuminated articles for clothing, with various designs and lighting effects, there is a continuing need for new forms of such products as fashion accessories, entertainment devices and promotional products.

SUMMARY OF THE INVENTION

The present invention helps meet the above-referenced need by providing an illuminated magnetic-clasp bottle cap comprising a bottle cap with a printed circuit board mounted thereon, the printed circuit board having an IC flasher circuit including a plurality of COB ("chip-on-board") LEDs mounted thereon, the bottle cap further comprising a low-profile epoxy dome covering the LEDs, a battery holder extending below the printed circuit board and the central portion of the bottle cap and containing at least one battery operatively connected to the IC flasher circuit, and a magnetic clasp for holding the bottle cap on an object with first and second mutually attractive parts of the magnetic clasp means located respectively on first and second surfaces of the object.

DETAILED DESCRIPTION OF PREFERRED EMBODIMENTS

Figure 1:
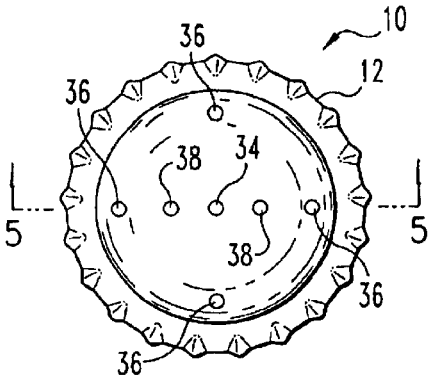
FIG. 1 is a top view of one embodiment of an illuminated bottle cap according to the present invention.

For the purpose of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device and such further applications of the principles of the invention as illustrated therein being contemplated as would normally occur to one skilled in the art to which the invention relates.

Referring to FIGS. 1–5, one embodiment of an illuminated bottle cap 10 according to the present invention includes a stamped metal bottle cap 12 of conventional size and shape for a beer or soft drink bottle or the like, a printed circuit board 14 affixed to an upper surface 16 of cap 12, and an epoxy dome 18 covering the circuit board and the upper surface of the bottle cap and at least partially covering a peripheral rim 20 of the bottle cap. The circuit board contains an IC flasher circuit which preferably includes one or more COB LEDs, i.e., LED dies wire bonded to the board. The flasher circuit is powered by one or more button cells 22, e.g., CR927 lithium cells, which are contained within a cylindrical battery holder having a threaded body 24 and a mating threaded cap 26, both of which are conductive metal in the disclosed embodiment. The battery holder is affixed to the back side of the circuit board by solder 27 or other suitable means.

Magnets 28 and 30 are provided inside and outside the battery holder, respectively, as a magnetic clasp for retaining the bottle cap in position on, for example, a shirt or other article of clothing. For example, magnet 30 may be held inside a shirt and the bottom of the bottle cap may be placed against the outer surface of the shirt over the point where magnet 30 is held, whereby the bottle cap may be retained in position by the magnetic attraction between the magnets. Magnet 28 also conducts electricity and thereby serves to complete the circuit between the bottom button cell and the bottom of the battery holder. An insulating sleeve 32 surrounds the button cells within the battery compartment. The sleeve may be a preformed cylindrical piece or may be a thin, flexible piece of insulating material, e.g., mylar, which is wrapped around the button cells. Electrical connections from battery holder body 24 and the top battery terminal to respective power supply pins of the IC are made via traces on the circuit board in a conventional manner.

As an alternative to a magnet inside the battery holder, battery cap 26 itself may be formed as a magnet. The separable part 30 of the magnetic clasp may be a permanent magnet or may be made of ferromagnetic material, which is attracted to the battery cap. Conversely, the battery cap may be made of ferromagnetic material attracted to permanent magnet 30. It is also contemplated that separable magnet 30 may be in the form of a magnetic ring the width of the bottle cap, whereby, with a ferromagnetic bottle cap material, the ring magnetically attracts the skirt of the bottle cap.

The circuit preferably has multiple LEDs arranged in a pattern and energized so as to flash in a desired sequence. An especially preferred pattern includes one LED 34 in the center of the circuit board, four LEDs 36 equally spaced around the perimeter, and two LEDs 38 located on radial lines between the center LED and two perimeter LEDs, as shown in FIG. 1. One preferred embodiment has a blue center LED, red outer LEDs and orange LEDs in between. The LEDs are preferably energized in sequence starting with the center LED and progressing out to the perimeter LEDs. A suitable IC for such a flash sequence is a type L1626B flasher commercially available from Tung Fai Hing Semiconductor Company, Shenzhen, China. The IC is preferably configured to operate in continuous sequential flashing mode once power is supplied thereto.

The epoxy may be clear but is preferably milky and is applied over the LEDs and the entire circuit board after the circuit board is positioned on the bottle cap. The bottle cap may have printing, e.g., a logo or other indicia, applied on the epoxy dome or under the epoxy.

Figure 2:
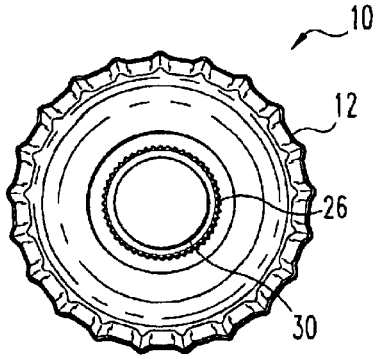
FIG. 2 is a bottom view of the bottle cap of FIG. 1.
Figure 3:
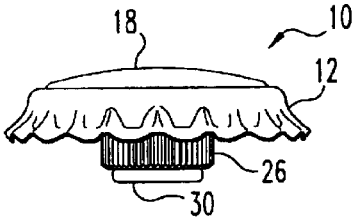
FIG. 3 is a side view of the bottle cap of FIG. 1.
Figure 4:
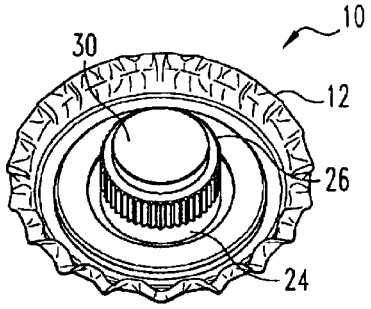
FIG. 4 is a bottom perspective view of the bottle cap of FIG. 1.
Figure 5:
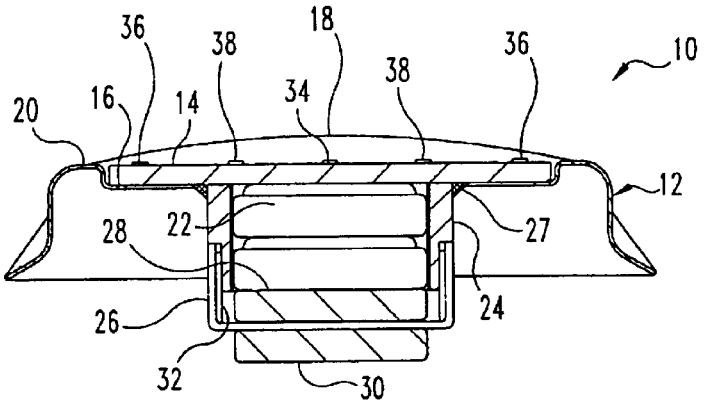
FIG. 5 is a cross-section of the bottle cap taken along line 5—5 of FIG. 1.

Threaded cap 26 may be provided with a knurled outer ring as shown in FIGS. 2–4 to facilitate opening and closing of the battery compartment as may desired in order to change batteries or to turn off the flasher circuit between periods of use. An elongated, nonconductive pull tab (not shown) is preferably provided between the button cells during initial assembly of the illuminated bottle cap, the pull tab extending radially outwardly from the button cells through a slot (not shown) provided for that purpose in the sidewall of body 24 of the battery holder. The pull tab maintains the flasher circuit in an off state during shipment from the factory and until a user chooses to activate the device. The pull tab mat be held in place by the friction created by tightening the cap 26 on the battery holder, and may be removed by simply loosening cap 26 and pulling the tab out of the slot. Retightening of cap 26 is sufficient to close the circuit and trigger the IC into continuous flashing mode.

While the invention has been illustrated and described in detail in the drawings and foregoing description, the same is to be considered as illustrative and not restrictive in character, it being understood that only preferred embodiments has been shown and described and that all changes and modifications that come within the spirit of the invention are desired to be protected.

I claim:

1. An illuminated magnetic-clasp bottle cap, comprising:

a bottle cap having a substantially circular central portion, a peripheral rim and a downwardly depending skirt;

a printed circuit board mounted on said bottle cap, said printed circuit board having an IC flasher circuit including a plurality of COB LEDs mounted thereon;

a low-profile epoxy dome covering said LEDs;

a battery holder extending below said printed circuit board and said central portion of said bottle cap, said battery holder containing at least one battery operatively connected to said IC flasher circuit; and magnetic clasp means for holding said bottle cap on an object with first and second mutually attractive parts of said magnetic clasp means located respectively on first and second surfaces of said object.

2. The illuminated magnetic-clasp bottle cap of claim 1, wherein said epoxy dome at least partially covers said peripheral rim of said bottle cap.

3. The illuminated magnetic-clasp bottle cap of claim 2, wherein said printed circuit board is mounted on top of said central portion of said bottle cap, wherein said central portion of said bottle cap has a central hole therethrough, and wherein said battery holder is mounted on the underside of said printed circuit board and extends through said hole in said central portion of said bottle cap.

4. The illuminated magnetic-clasp bottle cap of claim 3, wherein said first part of said magnetic clasp means is contained in said battery holder and said second part of said magnetic clasp means is separable therefrom.

5. The illuminated magnetic-clasp bottle cap of claim 4, wherein said plurality of LEDs includes a first LED positioned in the center of said central portion of said bottle cap, an inner plurality of LEDs radially spaced from said central LED, and an outer plurality of LEDs adjacent to said peripheral rim; and wherein said IC flasher circuit includes means for energizing said central LED, said inner plurality of LEDs and outer plurality of LEDs in sequence.

* * * * *

UNITED STATES PATENT AND TRADEMARK OFFICE

CERTIFICATE OF CORRECTION

PATENT NO. : 6,857,755 B1
DATED : February 22, 2005
INVENTOR(S) : Edward D. Lewis It is certified that error appears in the above-identified patent and that said Letters Patent is hereby corrected as shown below:

Column 3,
Line 16, change “mat” to -- may --.

Column 4,
Line 32, insert -- said -- after “and”.

Signed and Sealed this

Twenty-seventh Day of December, 2005

JON W. DUDAS
*Director of the United States Patent and Trademark Office*